US008181283B2

(12) United States Patent
Burch

(10) Patent No.: US 8,181,283 B2
(45) Date of Patent: May 22, 2012

(54) PIVOTAL FLOOR MOUNTED LOW FLOW URINAL

(76) Inventor: Michael L. Burch, Flint, MI (US)

( * ) Notice: Subject to any disclaimer, the term of this patent is extended or adjusted under 35 U.S.C. 154(b) by 360 days.

(21) Appl. No.: 12/511,094

(22) Filed: Jul. 29, 2009

(65) Prior Publication Data

US 2010/0275358 A1 Nov. 4, 2010

Related U.S. Application Data

(60) Provisional application No. 61/174,527, filed on May 1, 2009.

(51) Int. Cl.
*E03D 13/00* (2006.01)

(52) U.S. Cl. ..... 4/311

(58) Field of Classification Search ..... 4/311, 144.1, 4/301–310

See application file for complete search history.

(56) References Cited

U.S. PATENT DOCUMENTS

| | | | | |
|---|---|---|---|---|
| 3,500,480 | A * | 3/1970 | Michal, Jr. | 4/301 |
| 4,137,579 | A * | 2/1979 | Soler | 4/311 |
| 5,153,947 | A | 10/1992 | Markles | |
| 5,299,328 | A | 4/1994 | Walega | |
| 5,390,374 | A * | 2/1995 | Hubrig et al. | 4/301 |
| 5,655,230 | A | 8/1997 | Corbin | |
| 5,737,779 | A * | 4/1998 | Haddock | 4/301 |
| 5,799,340 | A * | 9/1998 | Hubrig et al. | 4/342 |
| 6,079,057 | A * | 6/2000 | Mette | 4/342 |
| 6,408,449 | B1 | 6/2002 | Aguirre | |
| 6,546,566 | B1 | 4/2003 | Geisel | |
| 6,671,891 | B2 | 1/2004 | Qi et al. | |
| 7,228,572 | B1 | 6/2007 | Holden | |
| 7,331,068 | B1 | 2/2008 | Tichenor | |
| 7,496,974 | B1 | 3/2009 | Kang | |

FOREIGN PATENT DOCUMENTS

| | | | |
|---|---|---|---|
| GB | 2368519 | A | 5/2002 |

* cited by examiner

*Primary Examiner* — Lori Baker
(74) *Attorney, Agent, or Firm* — Gifford, Krass, Sprinkle, Anderson & Citkowski, P.C.

(57) ABSTRACT

A low flow urinal includes a bowl which incorporates a plurality of spray nozzles communicated by an inlet flow line. A structurally supporting stem extends from a location of the bowl and terminates in a remote pivot support secured to a floor location. The bowl secures against an upright wall surface in a first non-use position. An underside extending support is integrally formed with an underside of the bowl and provides floor support of the bowl when rotated to a second floor supporting location. A second drain line extends from a drain location associated with the bowl, with either or both the inlet and outlet lines optionally communicating with an associated toilet or separately engaged with fluid supply and waste discharge lines.

18 Claims, 8 Drawing Sheets

PIVOTAL FLOOR MOUNTED LOW FLOW URINAL

CROSS-REFERENCE TO RELATED APPLICATIONS

The present application claims the priority of U.S. Provisional Patent Application Ser. No. 61/174,527, filed May 1, 2009.

FIELD OF THE INVENTION

The present invention relates generally to a low flow urinal design, such as which can be utilized as an auxiliary component of an existing toilet. More specifically, the present invention discloses a pivotal and floor mounted low flow urinal which includes an underside positioned support for positioning the urinal body a desired elevated distance generally corresponding to that associated with the conventional toilet and when displaced from a first vertically extending and wall secured position to a second floor supported use position.

BACKGROUND OF THE INVENTION

The present invention discloses a number of auxiliary urinal devices, such as for use with or as a standalone to an existing flush toilet. The concept behind auxiliary urinals is in seeking to minimize excessive water use associated with flushing a conventional toilet and which is typically necessitated in the discharge of solid waste.

Among the prior art relevant to this technology is the drained urine receptacle disclosed in U.S. Pat. No. 7,228,572 to Holden and which discloses an inverted truncated cone supported atop a length adjustable pivot arm which is internally hollowed to permit urine drain. The pivot arm is pedestal floor mounted and can include a spring coil base to facilitate pivoting between use and non-use positions.

Corbin, U.S. Pat. No. 5,655,230, teaches au auxiliary urinal retrofittable to an existing commode. The urinal is connected to a base plate which is placed between the base of the toilet and the floor and allows the urinal to drain liquid into the drain used by the commode. The urinal further exhibits a cup shaped head with a flush ring therein and a free standing semi-rigid drain line connected thereto and to the base plate to effect drainage. The semi-rigid drain line has limited travel segments to allow the user to manually position the urinal head to an optimum use position.

Another example of a wall mountable and low flow urinal is set forth in U.S. Pat. No. 7,331,068, issued to Tichenor, and which incorporates a misting water jet centered above the bowl. The water mist washes the entire bowl up to its upper edge and the water droplets that accumulate on the bowl are guided into the drain. A sensor is provided for initiating the flushing water mist, for a predetermined time interval and in response to detecting a user's presence.

SUMMARY OF THE INVENTION

The present invention discloses a low flow urinal includes a bowl which incorporates a plurality of spray nozzles communicated by an inlet flow line. A structurally supporting stem extends from a location of the bowl and terminates in a remote pivot support secured to a floor to corner location. The bowl secures against an upright wall surface in a first non-use position. An underside extending support is integrally formed with an underside of the bowl and provides floor support of the bowl when rotated to a second floor supporting location.

A second drain line extends from a drain location associated with the bowl, with either or both the inlet and outlet lines optionally communicating with an associated toilet or separately engaged with fluid supply and waste discharge lines. The inlet flow and/or drain lines can tap into the existing fluid lines servicing a standard toilet, in proximity to which the low flow urinal can be pivotally mounted. Alternatively, the urinal can be mounted as a stand-alone unit in communication with existing water inlet and waste discharge lines.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 6:
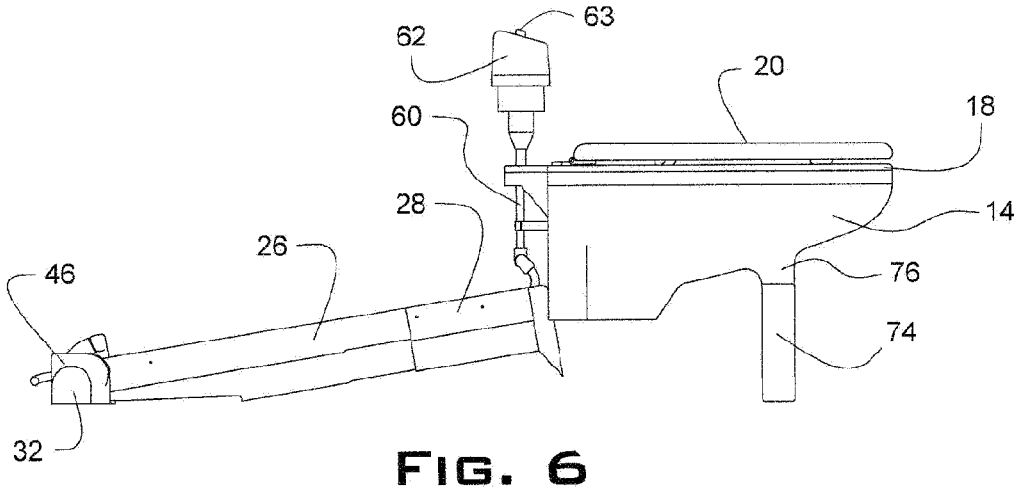
FIG. 6 is a side view of the urinal as shown in FIG. 3 in which its structurally supporting stem assists in pivoting the bowl to a forward use position about a lower wall edge secured pivot bracket.
Figure 7:
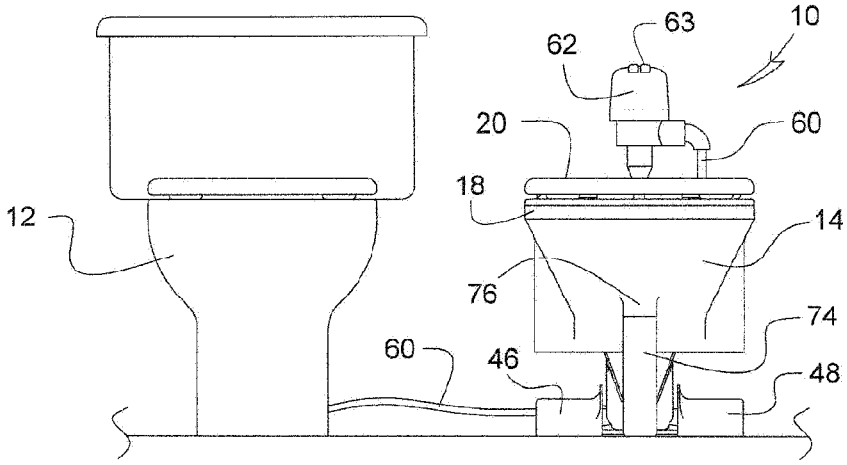
FIG. 7 is a front view similar to that previously shown in FIG. 4 and corresponding to the forward/downward pivoted position of FIG. 6.

Referring now to FIGS. 1-19, a series of plan, perspective, and sectional cutaway views are illustrated of a pivotal and wall mounted low flow urinal, shown at 10, in use with an existing toilet (see at 12 in FIG. 7). As will be described in additional detail, the urinal design 10 functions either as a stand-alone or as an auxiliary component in use with the existing toilet 12 and provides a low flow alternative for evacuating urinary (e.g. non fecal) deposits, while realizing significant water savings over the normal amount expended (typically a gallon or more) when flushing a conventional toilet.

The urinal 10 includes a body (such as constructed of porcelain but also contemplating plasticized composites) exhibiting a generally rounded or oval three dimensional bowl shape 14, such as further contemplating the use of a polymeric (e.g. sanitary plastic) or other suitable material. The bowl 14 can be configured for gripping and pivotally displacing by an individual and such as can include one or more gripping handles (not shown) extending outwardly from the front or sides of the bowl 14. An upper facing opening of the bowl 14 is surrounded by a rim supporting portion 18. The rim 18 is typically pivotally secured atop an upper edge 19 (again FIG. 5) of the bowl 14 and supports an underside of an associated lid 20.

A structurally supporting stem portion extends from a rear surface of the bowl 14 and includes at least one, and typically pairs of, structurally interconnecting sections 22 and 24. The structurally supporting stem can exhibit one fixed overall length or, as best shown in the exploded view of FIG. 5, the tubular sections 22 and 24 can be telescopingly engaged by brackets 25 and 27 with fasteners which seat within selected apertures defined at linear spaced locations along the telescoping portions 22 and 24 and in order to establish a desired length.

As further shown, outer structural or decorative sheathings, at 26 and 28, are provided as a fascia covering associated with the stem portions 22 and 24. The tubular sections 22 and 24 are also curved at their opposite non-interconnecting ends, with lower outwardly curved ends 30 of the sections 22 seating within a floor to wall corner mount bracket 32 with attaching bolt and nut fasteners 33.

Figure 5:
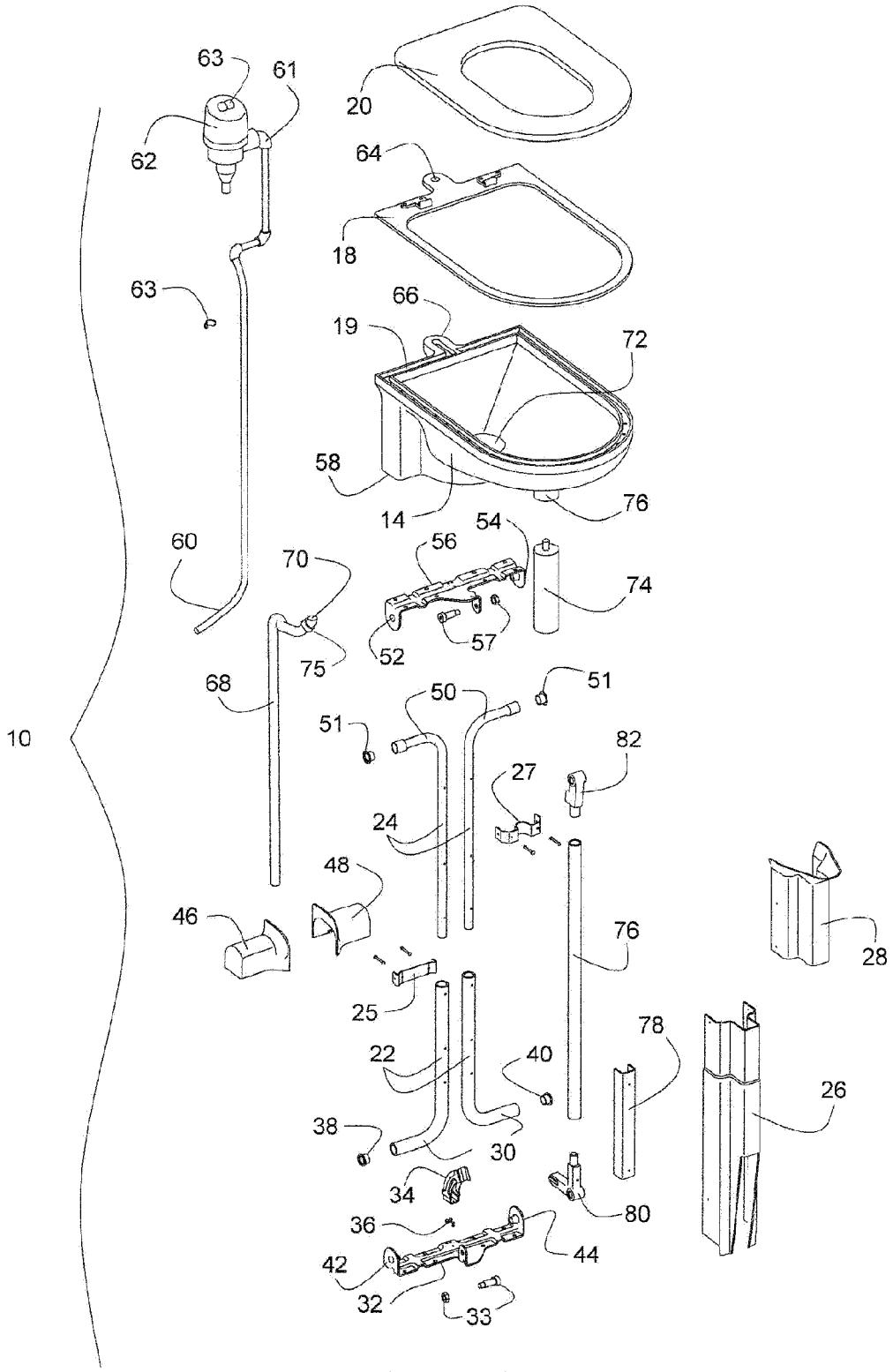
FIG. 5 is an exploded view of the pivotal and low flow wall mounted urinal.

Subsequent articulation of the stem is facilitated by an arcuate support and guide 34, this being secured by additional clips or fasteners (see at 36 in FIG. 5). Attachable end caps 38 and 40 secure a crosswise axis associated with the curved ends 30, and which are supported in a widthwise and channeled supported fashion between end defined flanges 42 and 44 associated with the corner mount bracket 32. Fascia pieces 46 and 48 secure to the extending leg portions associated with the bracket 32 and in order to cover the pivotally mounted ends 30 of the lower tubular portions 22.

As again best shown in FIG. 5, upper outwardly curved ends 50 associated with upper structurally connecting sections 24 includes attachable end caps 51 and is likewise engaged between end flange locations 52 and 54 associated with a second upper end located bracket 56 with associated fasteners 57 and which is in turn mounted to an underside level surface 58 associated with the main bowl shaped body. In this fashion, the structurally supporting stem establishes two pivot locations at the brackets 32 and 56, and so that the upper rim 18 of the bowl 14 maintains a continuous horizontal position between elevated and forwardly pivoted positions.

Figure 8:
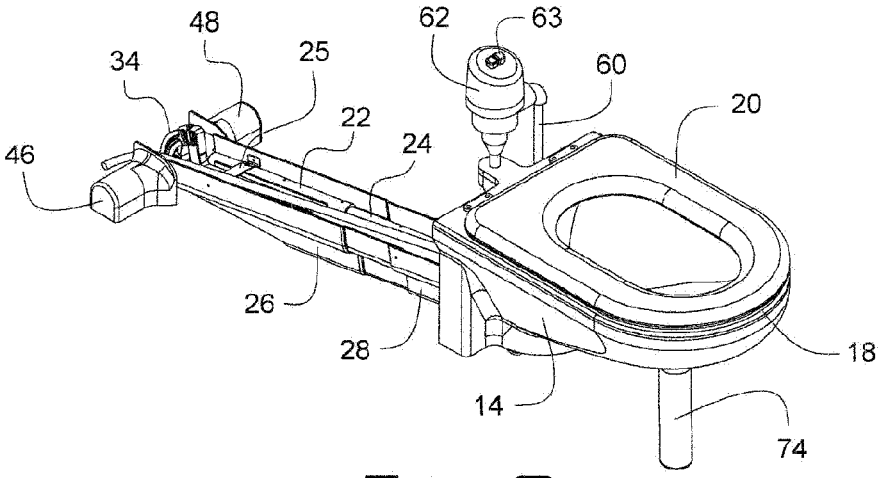
FIG. 8 is a perspective view of the urinal in the position shown in FIG. 6.

Although not shown, it is also understood that the structurally supporting stem can optionally be spring loaded, such as in a minor degree sufficient to assist in an upright retraction of the upright and horizontally maintained bowl 14 when not in use and without interfering with the floor supported use position depicted in FIGS. 6-8. It is also envisioned that a mechanical latch or trigger mechanism can be employed for maintaining the urinal body in the position references in FIGS. 1-4, and such as which can include a first latching portion extending from a wall surface location (not shown) which releasably engages a second portion secured to a rear opposing surface of the bowl 14.

A water supply line is shown at 60 and can tap into the conventional inlet line associated with the toilet 12 (see as best shown in FIG. 7), such as through the use of a conventional coupling or splitter. The inlet line 60 connects, at upper end 61, to a sensor 62 supported atop a rear location 64 (again FIG. 5) of the inner rim 18 and also includes a bracket 63 for securing at an intermediate location of the bowl 14. The sensor 62, in combination with an associated trigger mechanism 63, can include a spring valve construction which is powered or otherwise activated and is operable either by being manually triggered (or auto triggered upon the user standing over or sitting upon the rim 18) in order to activate the sensor 62 to expel a volume of fluid maintained in some degree of pressurization within the line 60 and to issue a predetermined spray misting or spritz of a small volume of water, such as along the inner surfaces of the bowl and which is typically far less than is typically associated with a fluid holding tank of the conventional toilet and required only to effectively clear and evacuate fluid waste associated with urine.

Figure 1:
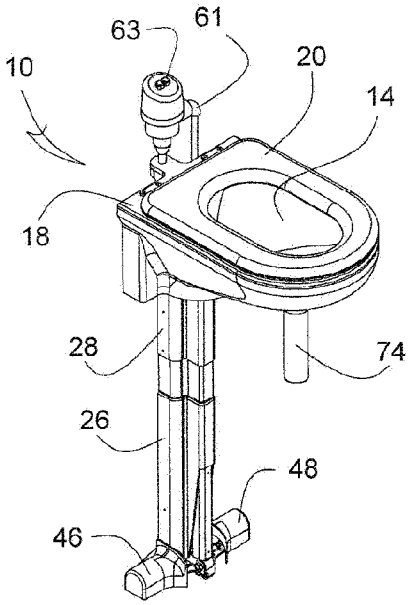
FIG. 1 is a perspective view of a pivotal and wall mounted low flow urinal according to the present invention.
Figure 2:
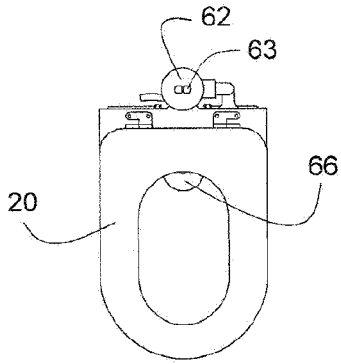
FIG. 2 is a top plan view of the urinal shown in FIG. 1.
Figure 3:
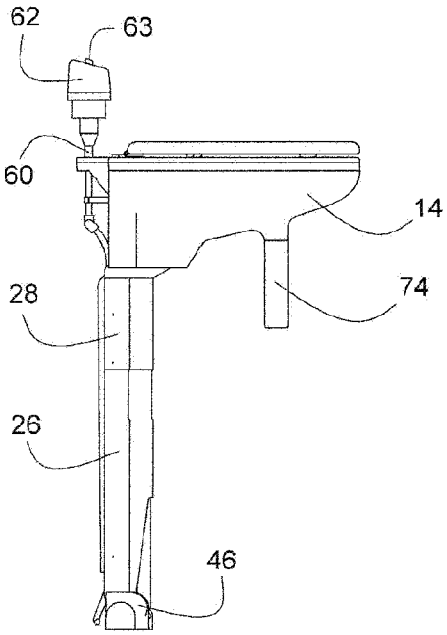
FIG. 3 is a right side view of the urinal.
Figure 4:
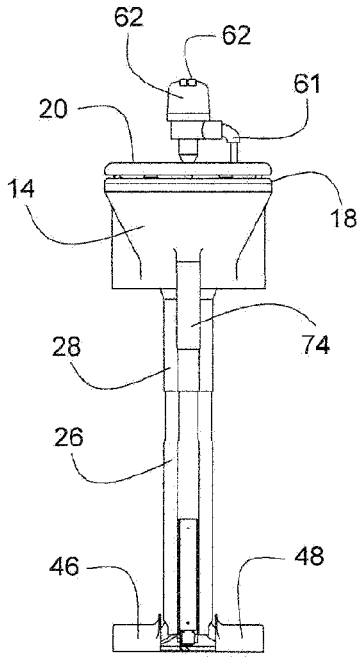
FIG. 4 is a front view of the urinal.
Figure 9:
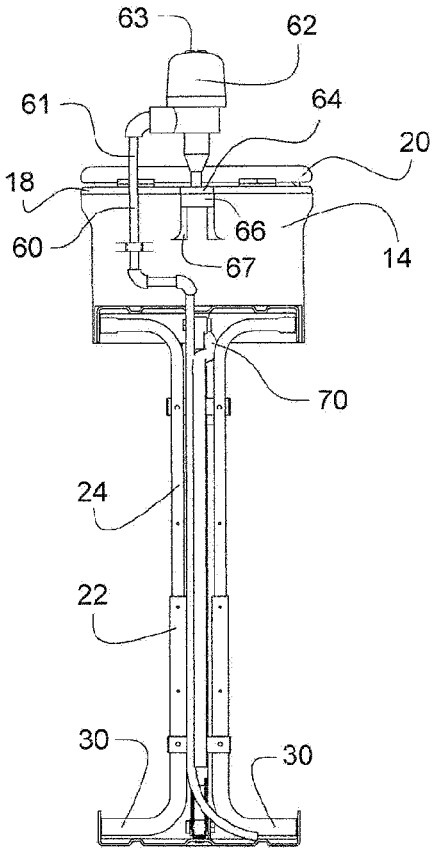
FIG. 9 is a rear view of the urinal in its upright position and showing the features of the inlet supply and outlet drain lines.

As shown in FIG. 9, an outlet portion of the fluid line extends downwardly from the sensor 62 and terminates in a dispensing assembly 66 positioned in an inner rear location of the bowl 16 (see also top view of FIG. 2). The dispensing assembly 66 typically includes one or more nozzles 67 (see as best shown in FIGS. 5 and 9) for administering the desired volume of spray (or spritz) within the bowl and in order to properly clean its surfaces. Although not shown, it is understood and envisioned that alternately configured spray distributing assemblies can also include a ring-shaped nozzle array arranged around an inner rim of the bowl and amongst any other desired arrangement for administering a fluid spray to the bowl interior.

A waste drainage line 68 includes an upper end 70 secured to a lower most drain location 72 associated with the bowl 14 (see again FIG. 5). As with the inlet line 60, the outlet line 68 can be provided as a smaller diameter flexible line (such as ¼" plastic). The drainage line 68 can be tapped, such as at 74 as shown in FIG. 10, and in order to connected to a conventional toilet drain location in a sufficiently gravity enabling discharge fashion, such as which is accomplished with the use of a diamond tipped drill bit or the like for effectively drilling through a surface location of the bowl pedestal, and in order to access the inner drain component.

Although not shown, additional components such as plumbers putty, sealants and fluid couplings can also be provided in order to effectively communicate the waste line 68 with the waste effluent associated with the toilet 12. Although not shown, it is also envisioned that the drain line can be reconfigured for hooking directly into a waste pipe extending under the flooring, this further supporting the alternate application apart from the conventional toilet.

Figure 10:
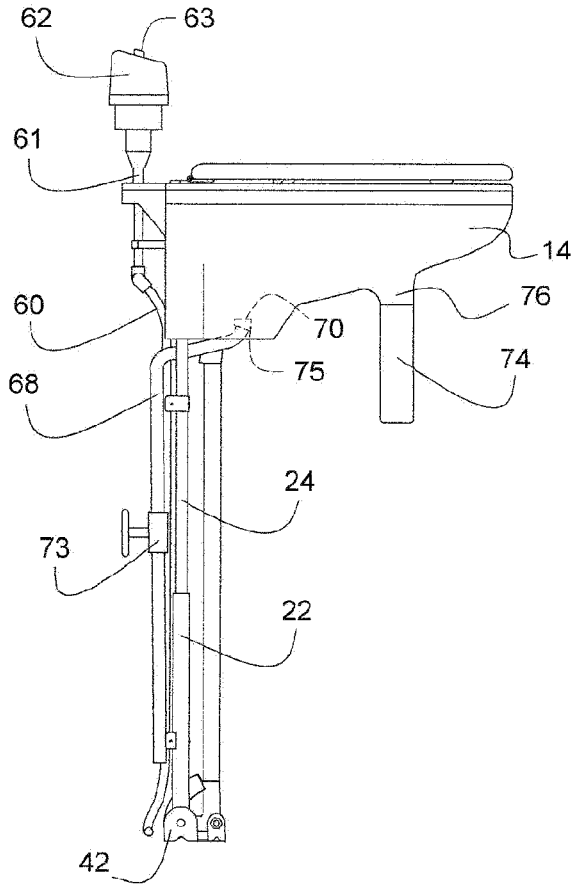
FIG. 10 is an enlarged side view similar to that shown in FIG. 3 and showing the structurally supporting stem in partial cutaway to better illustrate the arrangement of the inlet supply and outlet waste/drain lines.
Figure 11:
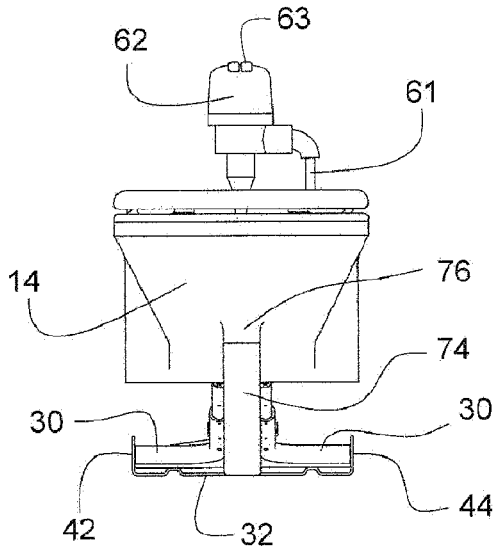
FIG. 11 generally replicates the view shown in FIG. 7, with the structural supporting stem in partial cutaway to better illustrate the bracket supports.

One or more flapper valves, such as shown at 75 in selected FIGS. 5 and 10, are built into the waste drainage line 68, such as at a location corresponding to drainage location 72 associated with the bowl 14 interior, this preventing the emanation of odors from the drain discharge line 68. Although not shown, it is also understood that a similar flapper valve or like component can also be incorporated into a drain tap location (not shown) associated the toilet 12, this operating in much the same fashion as well as to prevent the instance of solid waste backing into the drain line 68.

Figure 12:
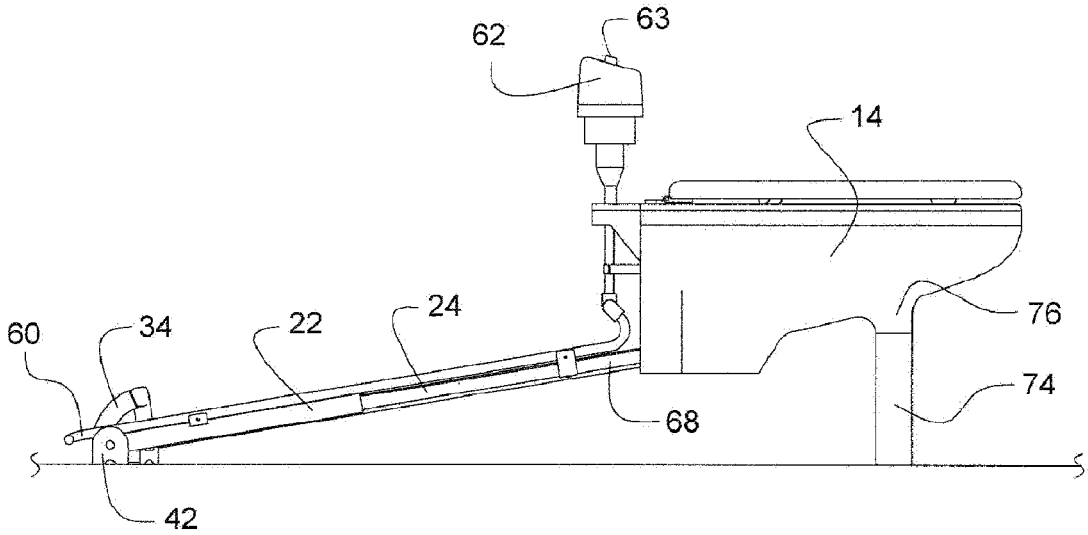
FIG. 12 generally repeats the illustration of FIG. 6 with outer sheathing of the structurally supporting stem removed in order to better illustrate the features of the floor to wall corner bracket mount along with the fluid inlet supply.
Figure 13:
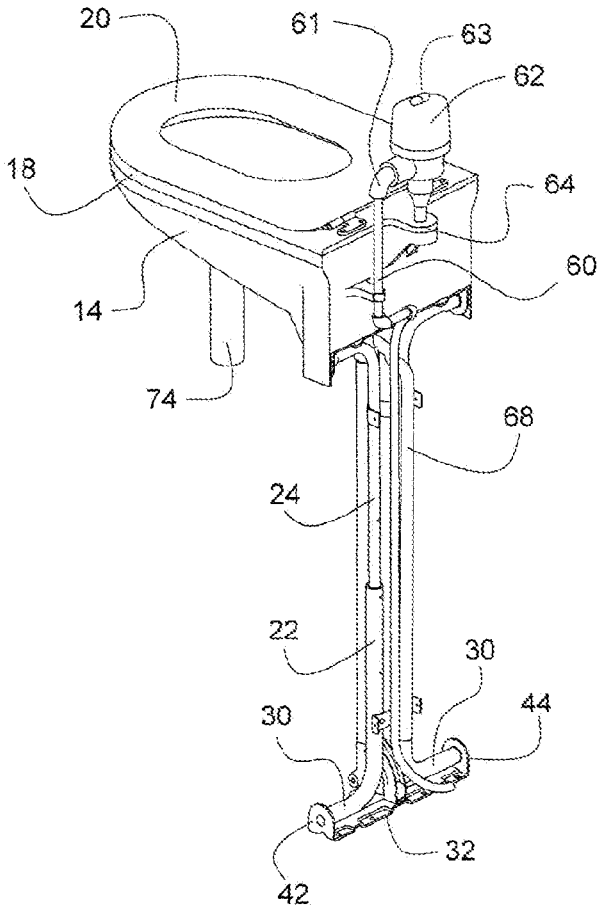
FIG. 13 is a rotated and rear side facing perspective of the urinal as substantially shown in the position of FIG. 10.
Figure 14:
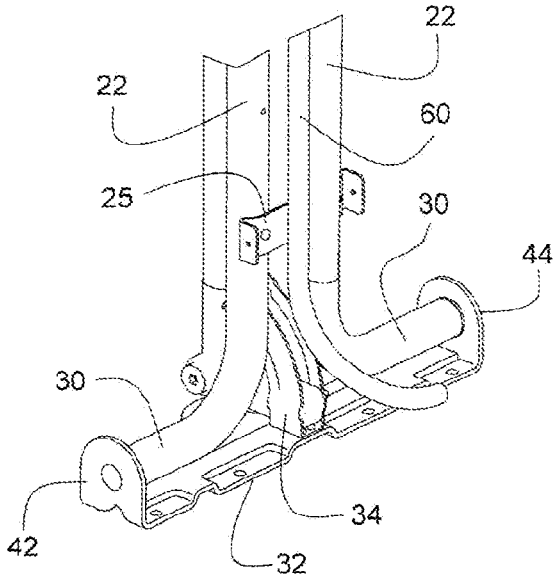
FIG. 14 is an enlarged bottom sectional view and better illustrating the features of the pivot bracket associated with the floor to wall mount and for providing pivoting support to the structural supporting stem.
Figure 15:
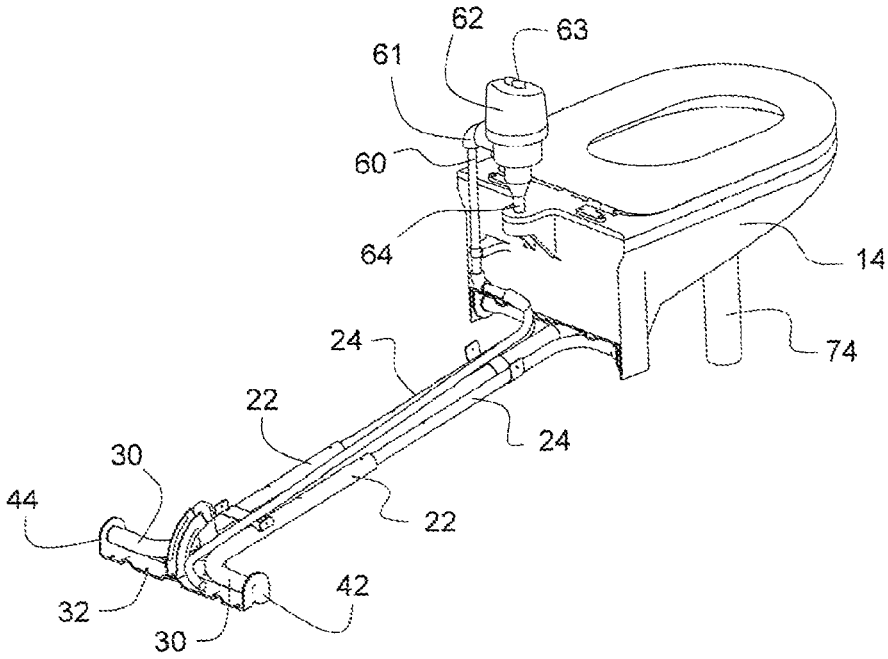
FIG. 15 is an opposite read side perspective of the urinal as substantially depicted in FIG. 12.
Figure 16:
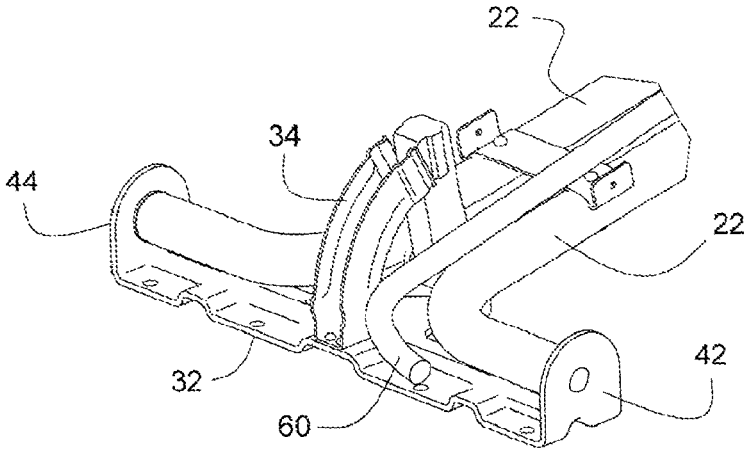
FIG. 16 is an enlarged bottom sectional view of the pivot bracket also shown in FIG. 14 and in illustrating in more detailed fashion the guided pivoting motion afforded the structural supporting stem relative to a pair of biasing and arcuated support guides.
Figure 17:
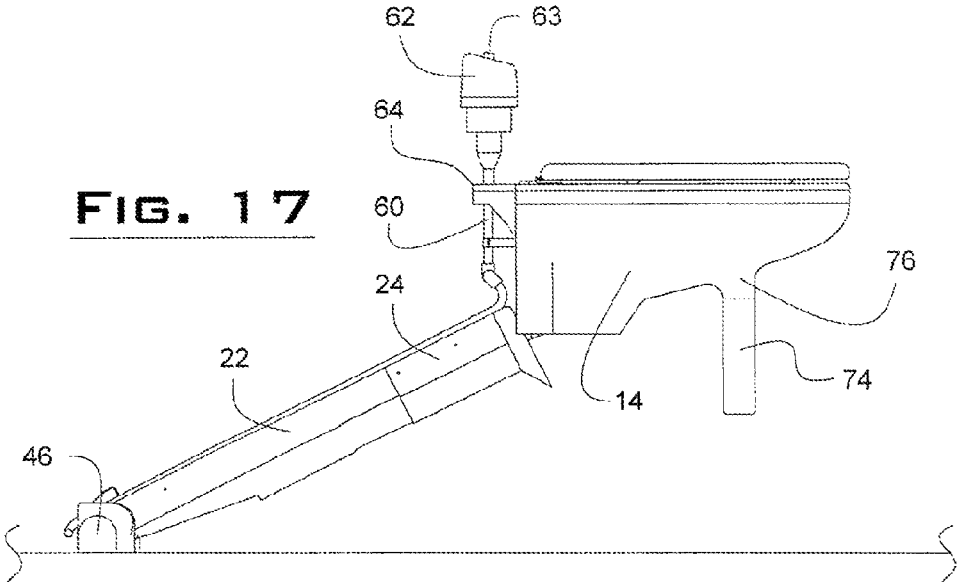
FIG. 17 is a side view illustrating the urinal in a generally mid-pivot position between the upright position of FIG. 3 and most forwardly pivoted position of FIGS. 6 and 12.
Figure 18:
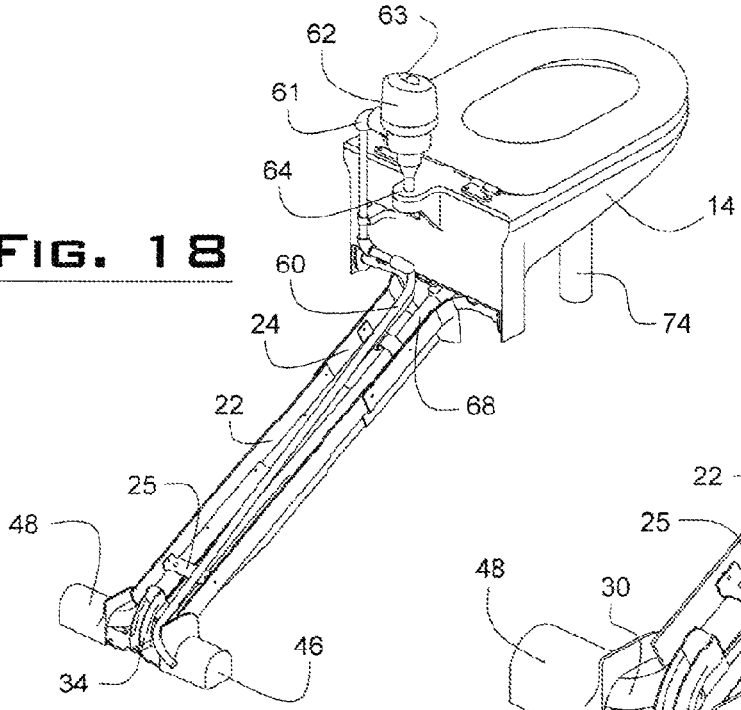
FIG. 18 is a perspective view generally corresponding to that shown in FIG. 15 and in which the structurally supporting stem is substantially illustrated without a top fascia covering.
Figure 19:
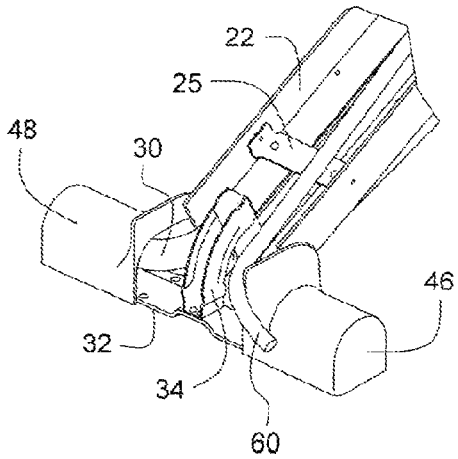
FIG. 19 is an enlarged bottom sectional view of the pivot bracket mount illustrated in FIG. 18.

Additional features can include the provision of an upper mechanical or magnetic latch for securing the bowl 14 in an upright and substantially stored/flush position against an elevated wall location. Upon being released from the latch, the bowl 14 is permitted to rotate downwardly in the manner illustrated and in order to be supported in the use position shown in FIG. 1 and in which the bowl 14 is secured upon a downwardly extending support 74 which further includes a screw attached upper end for mounting the support 74 to an underside location 76 of the bowl 14 and in order to space the urinal bowl 14 a distance above a floor location (against which the bottom end of the support 74 contacts as best shown in FIG. 12) which is generally commensurate with the height of the conventional toilet seat. In this fashion, the urinal can also be effectively used by females in a sitting position. The bowl 14 also provides the ability to be repositioned in height relative to the floor, while retaining its horizontal orientation.

Other features best shown in the exploded view of FIG. 5 include additional vertical structural supporting member 76 incorporated into the stem. An additional reinforcing bracket 78 is pivotally secured at a lower end by a first attachable component 80, as well as at an elevated bowl underside location by a second component 82.

Having described my invention, other and additional preferred embodiments will become apparent to those skilled in the art to which it pertains and without deviating from the scope of the appended claims. Such include the reconfiguration of the pivot support bracket 32 to secure to a supported and elevated location of the wall. Concurrently, the urinal can be reconfigured to pivot downwardly in front of the conventional toilet 12, and as opposed to being mounted for side displaced use as shown in the drawings.

I claim:

1. A low flow urinal convertible between elevated non-use and lowered and floor supported use positions, comprising:

a bowl shaped body to which is communicated an inlet fluid line and an outlet waste discharge line;

a downwardly extending support extending from an underside of said bowl and spacing said bowl a distance above a floor location in the use position; and a structurally supporting stem hingedly secured to a bracket mounted to an underside of said bowl and terminating in a further pivotal bracket secured to a fixed location which permits the bowl to be pivoted between the elevated non-use position in which a rear of the bowl abuts against a wall and the lowered and floor supported position in which the bowl is accessible.

2. The urinal as described in claim 1, further comprising said inlet line connecting at upper end to a sensor supported upon said bowl, a trigger mechanism incorporated into said sensor and being activated to expel a volume of fluid from said bowl.

3. The urinal as described in claim 2, further comprising an outlet portion of said fluid line extending downwardly from said sensor and terminating in a dispensing assembly positioned at an inner location of said bowl, said dispensing assembly including at least one nozzle for administering the desired volume of spray within said bowl and in order to properly clean its surfaces.

4. The urinal as described in claim 1, said stem further comprising at least one pair of structurally interconnecting sections which are covered by fascia pieces.

5. The urinal as described in claim 4, said stem further comprising first and second pairs of structural defining and tubular sections which are telescopically connected.

6. The urinal as described in claim 5, further comprising said pairs of tubular sections being curved at opposite non-interconnecting ends, with a first pair of lower outwardly curved ends seating within said further pivotal bracket which comprises a corner mount bracket.

7. The urinal as described in claim 6, further comprising an arcuate support and guide secured atop said corner mounted bracket for controlling pivoting of a lower most tubular section associated with said stem.

8. The urinal as described in claim 6, further comprising a second opposite pair of outwardly curved ends of said tubular sections which are engaged between end flange locations associated with said bracket mounted to the bowl.

9. The urinal as described in claim 1, said outlet discharge line extending from a drain formed in said bowl, a flapper valve located in said drain.

10. The urinal as described in claim 1, further comprising a rim supporting portion pivotally secured atop said bowl and supporting an underside of an uppermost positioned lid.

11. A pivotal urinal, comprising:

a three dimensional shaped bowl to which is communicated an inlet fluid line and an outlet waste discharge line, said bowl further including a downwardly extending support;

said inlet line connecting at upper end to a sensor supported upon said bowl, a trigger mechanism incorporated into said sensor and being activated to expel a volume of fluid from said bowl;

an outlet portion of said fluid line extending downwardly from said sensor and terminating in a dispensing assembly positioned at an inner location of said bowl, said dispensing assembly including at least one nozzle for administering the desired volume of spray within said bowl; and a structurally supporting stem hingedly secured to a bracket mounted to an underside of said bowl and terminating in a further pivotal bracket secured to a fixed location which permits the bowl to be pivoted between an elevated and non-use position against a wall and a downward use position in which said downwardly extending support engages upon a floor.

12. The urinal as described in claim 11, said stem further comprising at least one pair of structurally interconnecting sections which are covered by fascia pieces.

13. The urinal as described in claim 12, said stem further comprising first and second pairs of structural defining and tubular sections which are telescopically connected.

14. The urinal as described in claim 13, further comprising said pairs of tubular sections being curved at opposite non-interconnecting ends, with a first pair of lower outwardly curved ends seating within said further pivotal bracket which comprises a corner mount bracket.

15. The urinal as described in claim 14, further comprising an arcuate support and guide secured atop said corner mounted bracket for controlling pivoting of a lower most tubular section associated with said stem.

16. The urinal as described in claim 14, further comprising a second opposite pair of outwardly curved ends of said tubular sections which are engaged between end flange locations associated with said bracket mounted to the bowl.

17. The urinal as described in claim 11, said outlet discharge line extending from a drain formed in said bowl, a flapper valve located in said drain.

18. The urinal as described in claim 11, further comprising a rim supporting portion pivotally secured atop said bowl and supporting an underside of an uppermost positioned lid.

* * * * *